United States Patent [19]

Nagy

[11] 4,240,356

[45] Dec. 23, 1980

[54] MODULAR STORAGE ARRANGEMENT FOR A PASSENGER VEHICLE

[75] Inventor: Ernest J. Nagy, Munster, Ind.

[73] Assignee: Pullman Incorporated, Chicago, Ill.

[21] Appl. No.: 961,576

[22] Filed: Nov. 17, 1978

[51] Int. Cl.[3] ..... B61D 35/00

[52] U.S. Cl. ..... 105/323; 105/315; 52/67

[58] Field of Search ..... 105/323, 314, 315; 296/23 R

[56] References Cited

U.S. PATENT DOCUMENTS

| | | | |
|---|---|---|---|
| 2,307,560 | 1/1943 | Apel | 105/323 |
| 4,100,857 | 7/1978 | Gutridge et al. | 105/323 |

*Primary Examiner*—Richard A. Bertsch

*Attorney, Agent, or Firm*—Richard J. Myers

[57] ABSTRACT

A storage arrangement for a passenger compartment in a railway passenger vehicle including a vertical panel extending between and removably secured to the ceiling and floor of the vehicle and having a cabinet shell secured thereto to provide an easily assembled and maintained baggage containment or storage arrangement within the compartment.

11 Claims, 4 Drawing Figures

FIG. 3
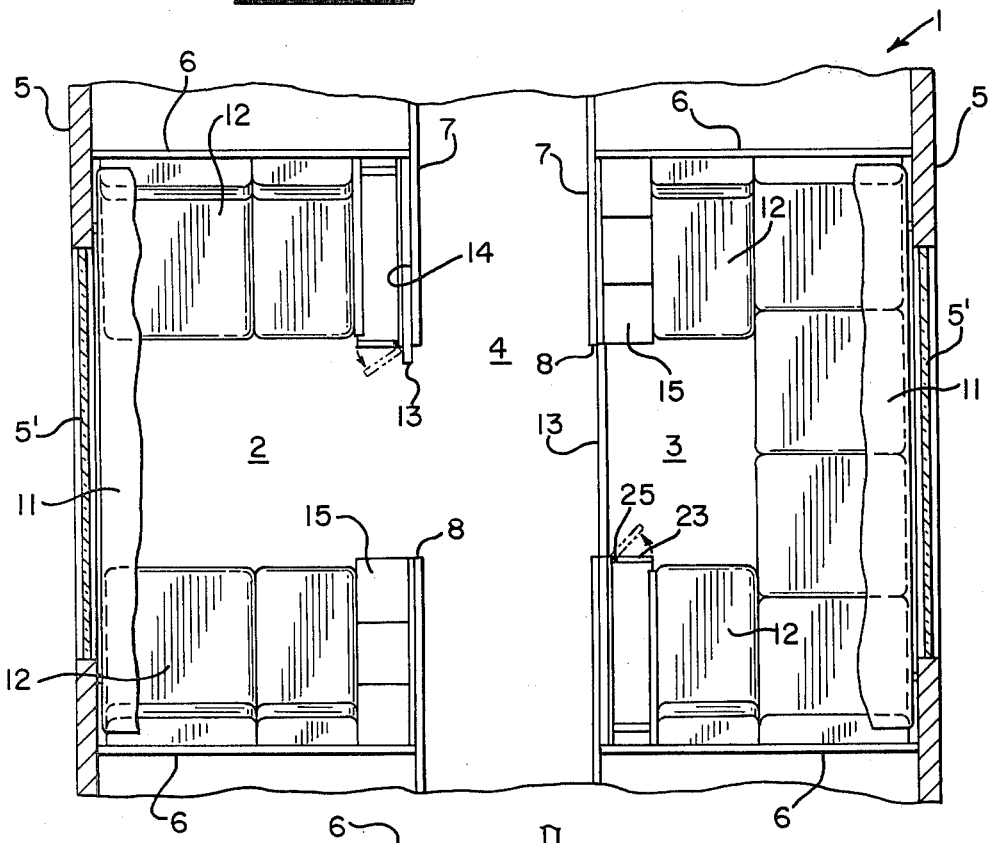
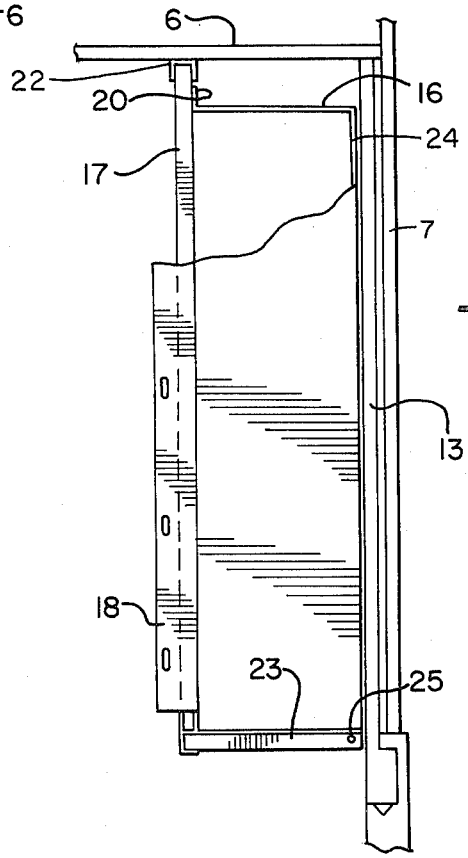
FIG. 4

MODULAR STORAGE ARRANGEMENT FOR A PASSENGER VEHICLE

BACKGROUND OF THE INVENTION

1. Field of the Invention

The present invention relates to passenger vehicle compartments and in particular storage arrangements within railway passenger vehicle compartments.

2. Description of the Prior Art

The prior art shows a variety of storage arrangements for railway passenger car compartments. None, however, discloses the novel modular storage arrangement embodied in the present invention.

SUMMARY OF THE INVENTION

The present invention relates to passenger vehicle compartments and in particular to railway sleeping car storage arrangements. The storage arrangement includes a vertical panel removably secured to the ceiling and floor of the compartment to which a cabinet shell is secured intermediate a compartment wall and the panel in a convenient and compact manner. By this arrangement, the panel provides a support for the cabinet which accommodates ease of assembly, removal, repair and replacement of the cabinet during field service of the vehicle as well as a relatively light baggage containment construction within the compartment.

BRIEF DESCRIPTION OF THE DRAWINGS

FIG. 3 shows a plan view of a plurality of adjacent sleeping compartments; and

FIG. 4 shows an enlarged horizontal section taken substantially at line 4—4 in FIG. 1.

DESCRIPTION OF THE PREFERRED EMBODIMENT

Figure 2:
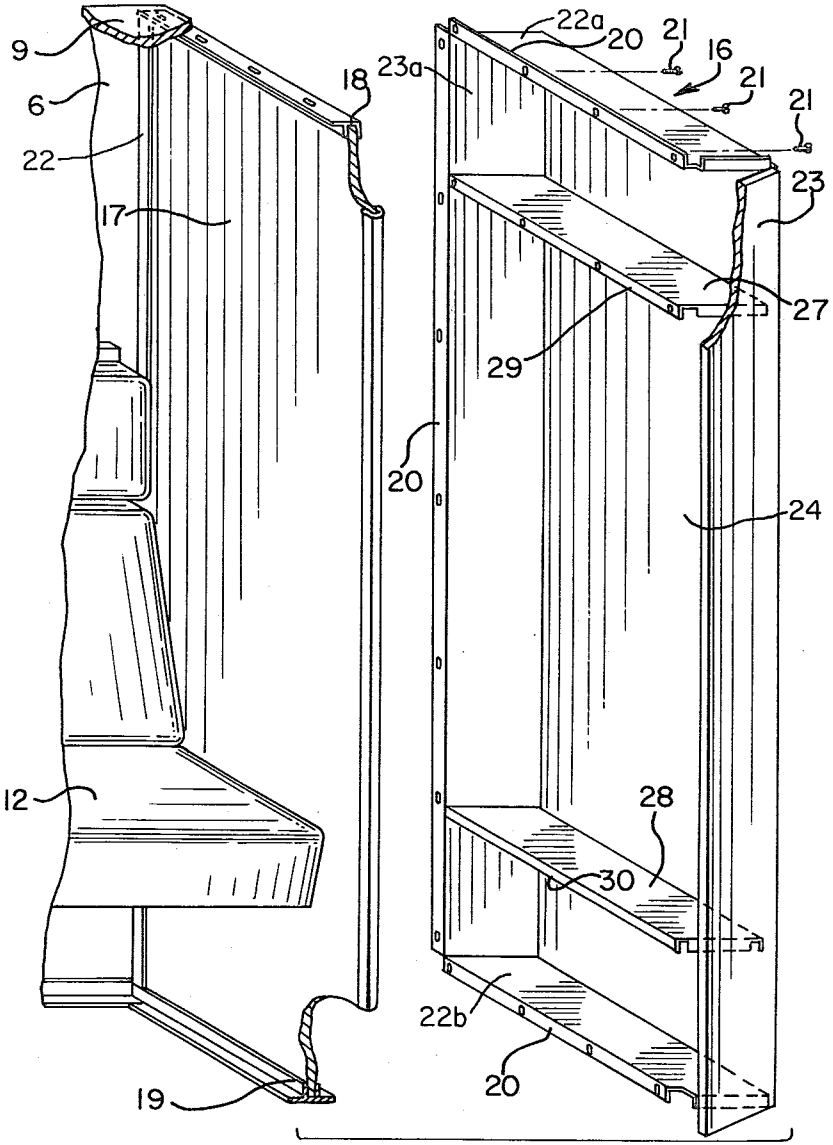
FIG. 2 shows an exploded perspective view of the cabinet arrangement.
Figure 1:
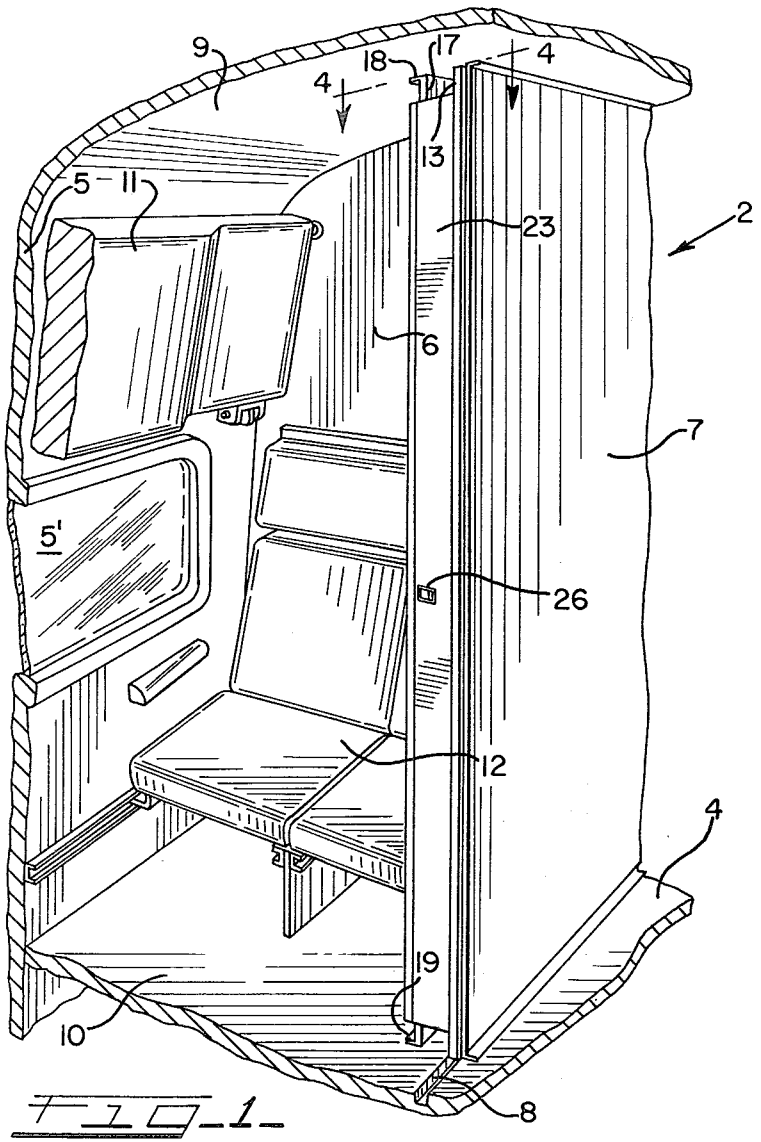
FIG. 1 shows a perspective view of a portion of a railway sleeping compartment embodying the present invention.

The present invention is particularly suited for railway sleeping compartments where a convenient yet durable and easily fabricated and maintained shelving and storage arrangement is desired yet occupies a minimum of compartment space.

As shown in the drawings, a sleeping car 1 includes a plurality of adjacent passenger compartments 2, 3 disposed on opposite sides of an aisle 4. Each compartment includes an outer wall 5 having a window 5', lateral partition walls 6, inner longitudinally extending partition walls 7 having a doorway 8 therebetween, a roof or ceiling 9, flooring 10, and an upper sleeping berth 11 and convertible passenger seats 12, both of which may be moved as desired from the daytime traveling arrangement as in compartment 2 and the made-up sleeping arrangement as in compartment 3. Also, to provide privacy for each compartment, a sliding door 13 is provided which is movable between the closed position covering the doorway as illustrated in compartment 3 to the open position where it is stowed in the recess or slot 14 as shown in compartment 2 in FIG. 3.

Within each of the compartments 2, 3 a steptable 15 such as that disclosed in U.S. Pat. No. 4,179,996, Jack E. Gutridge, et al, issued on Dec. 25, 1979. is provided adjacent the inner end of one of the convertible seats 12 and the novel storage arrangement embodying the present invention is provided adjacent the inner end of the other convertible seat 12. More particularly, a cabinet 16 of a preformed fiberglass or sheet metal flanged construction which is secured to and thus supported on a vertical panel 17 by peripheral flanges 20 and screws 21 or other appropriate fasteners. The panel 17 extends between and is secured to the ceiling 9 and flooring 10 by upper and lower channel flanges 18 and 19 which are in turn secured to the ceiling and flooring by screws or other well known means. Similarly, channel bracket 22 mounted on the lateral partition wall 6 secures the panel 17 thereto. To assemble the arrangement, each panel 17 may be slid into position with the cabinet 16 secured to it, or alternatively, the storage arrangement may be assembled with the panel 17 in place, thus providing a modular cabinet arrangement which is easily assembled and repaired at a field repair facility.

Each cabinet also includes top and bottom walls **22*a*, 22*b*, end wall 23*a* and a hinged door 23, for which the open position is shown in phantom lines in the drawings, coupled to the vertical inner or backing wall portion 24 by vertically spaced hinges 25 and secured in the closed position by a conventional door latch 26. Additionally, upper and lower shelves 27 and 28 are provided within the cabinet 16. The shelves are secured about their peripheries by peripheral flanges 29 and 30** and screws, rivets or other appropriate means to the cabinet and the panel, thus providing structural rigidification as well as a lightweight, convenient shelving arrangement.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. In a railway passenger vehicle having a passenger compartment including a floor and ceiling and a vertical compartment wall extending therebetween, an improved compartment storage arrangement comprising:

a vertical panel outwardly spaced from and being substantially parallel to said compartment wall and including upper and lower edge portions respectively coupled with the ceiling and floor of the compartment, coupling means removably securing said upper and lower edge portions with said ceiling and floor, a cabinet shell intermediate said compartment wall and panel including an inner vertical wall portion and peripheral wall portions extending outwardly therefrom to said panel about the top, rear and bottom periphery of said shell and having flange portions couplable with said panel and fastening means securing said flange portions to said panel.

2. The invention in accordance with claim 1, and said cabinet shell having at least one shelf extending horizontally outward from said vertical wall portion and rigidly interconnected with said panel.

3. The invention in accordance with claim 1, and a cabinet door hingedly connected to said vertical wall portion and movable to span the front periphery of said shell between said vertical wall portion and said panel in covering relation.

4. The invention in accordance with claim 1, and said compartment wall having an access doorway therethrough and a compartment door movable to an open position inward of said compartment wall and generally adjacent the doorway, and said cabinet shell being outwardly spaced from said inner wall to receive said door therebetween.

5. The invention in accordance with claim 1, and said inner vertical and peripheral wall portions of said cabinet shell being of a unitary construction.

6. The invention in accordance with claim 1, and said compartment having a second vertical compartment wall intersection said first mentioned compartment wall and the rearward edge of said vertical panel, and said peripheral flange about the rear of said cabinet shell being spaced from said second wall portion between the floor and ceiling of the car.

7. In a railway passenger vehicle having a passenger compartment including a floor and ceiling and a vertical compartment wall extending therebetween, an improved compartment storage arrangement comprising:

a vertical panel outwardly spaced from and being substantially parallel to said compartment wall and including upper and lower edge portions respectively positioned adjacent to ceiling and floor of the compartment, coupling means removably securing said upper and lower edge portions with said ceiling and floor, a cabinet shell intermediate said compartment wall and panel including an inner vertical wall portion and peripheral wall portions extending outwardly therefrom to said panel about the top, rear and bottom periphery of said shell and having flange portions couplable with said panel, and fastening means securing said flange portions to said panel, and said coupling means being channel-shaped flanges secured to said ceiling and floor and said respective upper and lower portions being slidingly engageable therewithin.

8. In a railway passenger vehicle having a passenger compartment including a floor and ceiling and a vertical compartment wall extending therebetween, an improved compartment storage arrangement comprising:

a vertical panel outwardly spaced from and being substantially parallel to said compartment wall and including upper and lower edge portions respectively coupled with the ceiling and floor of the compartment, coupling means removably securing said upper and lower edge portions with said ceiling and floor, a cabinet shell intermediate said compartment wall and panel including an inner vertical wall portion and peripheral wall portions extending outwardly therefrom to said panel about the top, rear and bottom periphery of said shell and having flange portions couplable with said panel and fastening means securing said flange portions to said panel, said compartment having a second vertical compartment wall extending substantially perpendicular to said first mentioned compartment wall, vertically extending channel bracket means on said second wall, and said panel including vertically extending rear edge portions slidably removably receivable within said channel bracket means to secure the panel to said second wall.

9. In a railway passenger vehicle having a passenger compartment including upper and lower portions and a vertical compartment wall extending therebetween, an improved compartment storage arrangement comprising:

a vertical panel outwardly spaced from and being substantially parallel to said compartment wall and including upper and lower edge portions and respectively positioned adjacent to the upper and lower portions of the compartment, coupling means securing said upper and lower edge portions of said panel to said upper and lower portions of of said compartment for edgewise assembly and removal of said panel with respect thereto, a cabinet shell being hung from said panel intermediate said compartment wall and panel and, means fastening said shell to said panel whereby the same is insertible and removable as a unit with said shell with respect to said coupling means.

10. The invention in accordance with claim 9, and said coupling means being slidably mounted with the upper and lower edges of the panel.

11. A railway passenger car having a passenger compartment comprising:

a floor and ceiling, an upright compartment wall extending between the floor and the ceiling, a vertical panel wall spaced outwardly of and substantially parallel to the compartment wall and including upper and lower edge portions coupled with the ceiling and the floor, a transverse partition wall connecting with the compartment wall and with the panel, a vertical backing wall between the compartment wall and the panel and being generally parallel with both and defining with the panel a cabinet, the cabinet having an open entrance end, a cabinet door hingedly mounted on said compartment wall and engageable with the panel in covering relation to close the cabinet, the backing wall and the corridor wall forming a door receiving recess, and a compartment door slidably disposed in the recess between said compartment wall and said backing wall in a stored position and movable therefrom to a closing compartment position.

* * * * *